United States Patent [19]

Behringer

[11] Patent Number: 4,790,600

[45] Date of Patent: Dec. 13, 1988

[54] TASK CHAIR

[75] Inventor: John Behringer, North Kingstown, R.I.

[73] Assignee: J. G. Furniture Systems, Inc., Quakertown, Pa.

[21] Appl. No.: 3,866

[22] Filed: Jan. 16, 1987

[51] Int. Cl.[4] ..... A47C 1/02

[52] U.S. Cl. ..... 297/337; 297/296

[58] Field of Search ..... 297/337, 338, 339, 313, 297/353, 296, 297, 298

[56] References Cited

U.S. PATENT DOCUMENTS

| | | | |
|---|---|---|---|
| 530,880 | 12/1894 | Briggs | 297/296 X |
| 1,369,551 | 10/1919 | Wolary | 297/296 X |
| 2,054,557 | 9/1936 | Cramer et al. | 297/349 X |
| 2,364,261 | 12/1944 | Wood | 297/298 |
| 2,853,125 | 9/1958 | Starke | 297/283 |
| 3,193,239 | 7/1965 | Monroe | 297/337 X |
| 3,235,308 | 2/1966 | Conner | 297/337 |
| 3,635,524 | 1/1972 | Faust | 297/338 |

FOREIGN PATENT DOCUMENTS

| | | | |
|---|---|---|---|
| 226408 | 3/1963 | Austria | 297/284 |

*Primary Examiner*—Francis K. Zugel

*Attorney, Agent, or Firm*—Nixon & Vanderhye

[57] ABSTRACT

An office, or task, chair comprising an integrally formed brace comprising a combination seat support and back support connected to a chair base by a piston/-cylinder height adjustment mechanism. A seat is mounted on the seat support for forward and backward sliding adjustment and for pitch adjustment. A seat back is mounted for sliding adjustment on the back support portion of the brace. The seat support and seat back support portions of the brace are connected by an integrally formed hinge or flex area which permits the seat back support to incline and twist with respect to the seat support portion. Adjustments of the seat with respect to the seat support are carried out in association with dual, concentric handwheels reachable by a user from a seated position. Adjustment of the seat back is done in association with another handwheel located on the rear face of the seat back.

8 Claims, 5 Drawing Sheets

FIG. 9
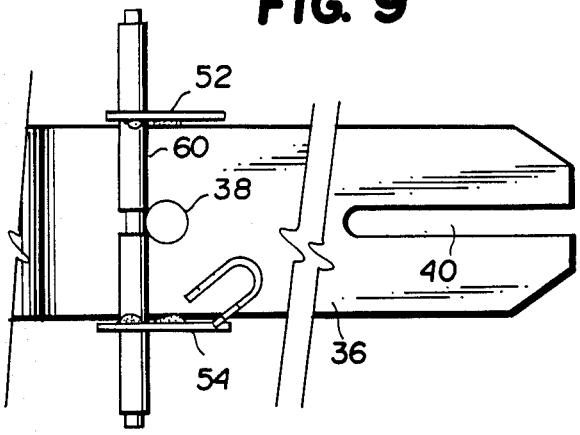
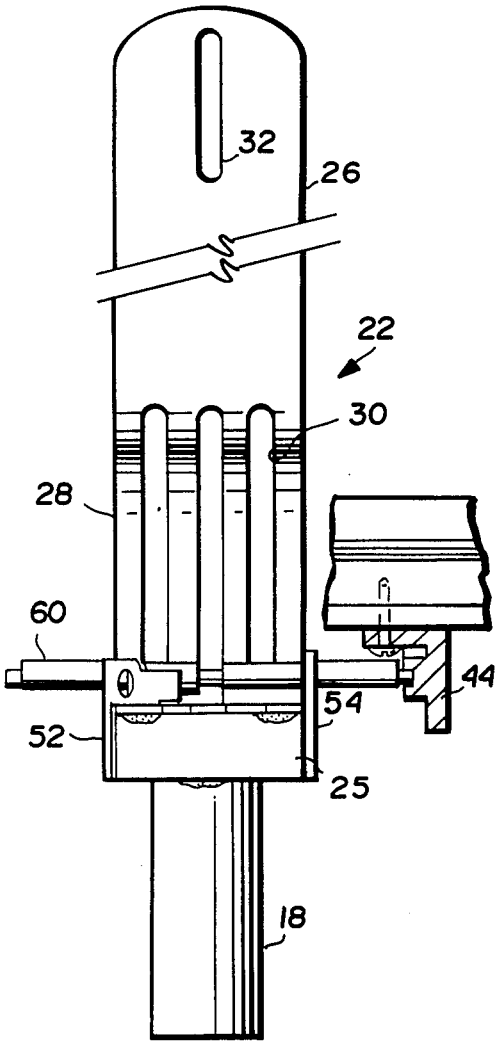
FIG. 10
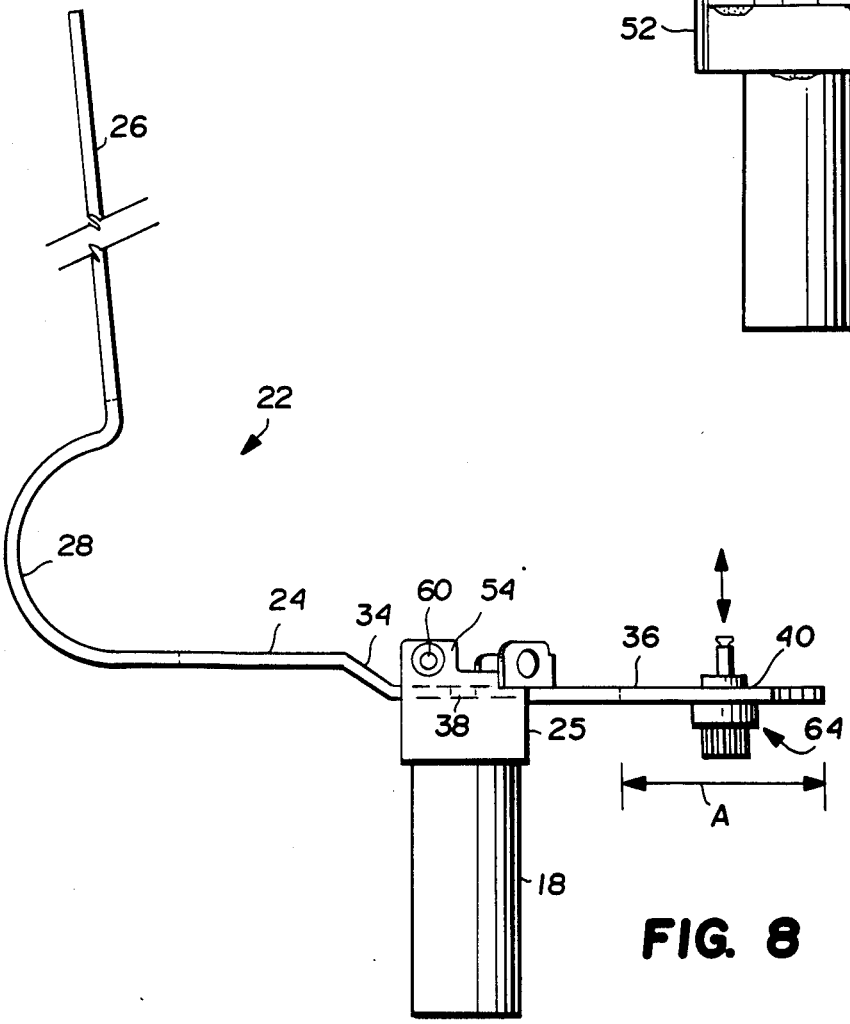
FIG. 8

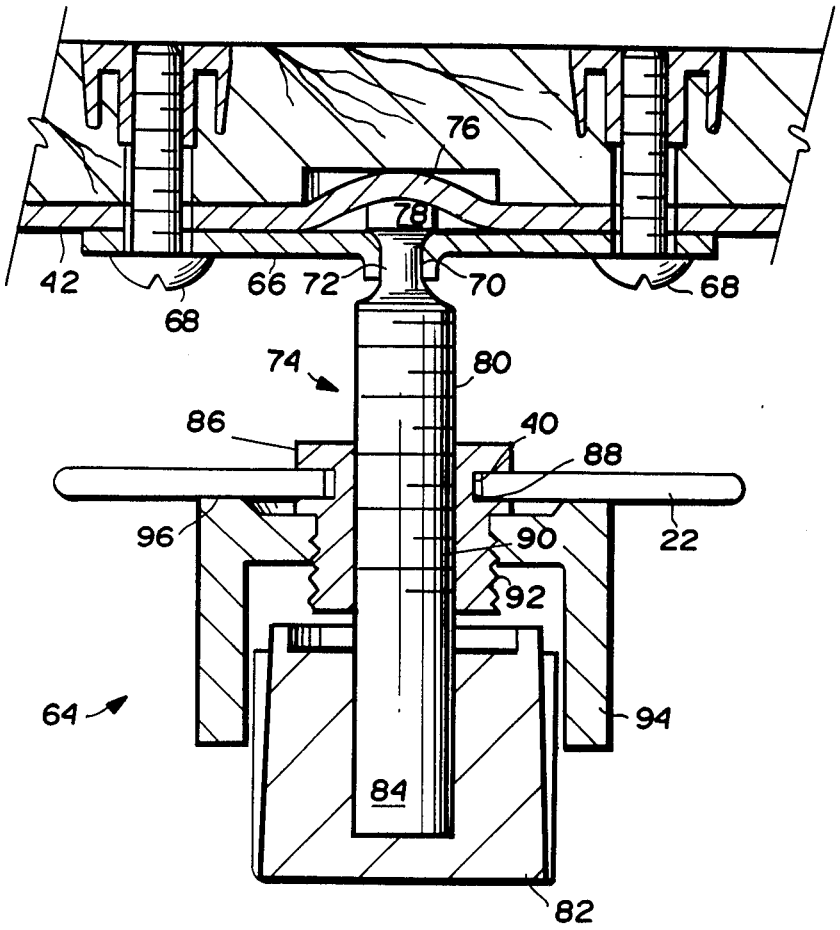
FIG. 11
FIG. 12
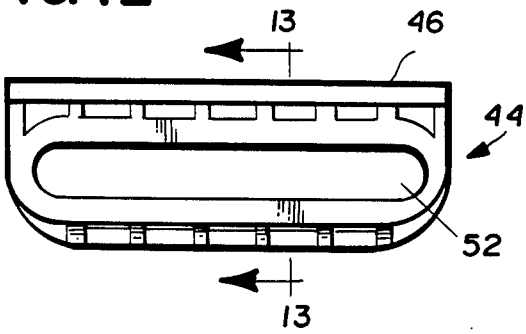
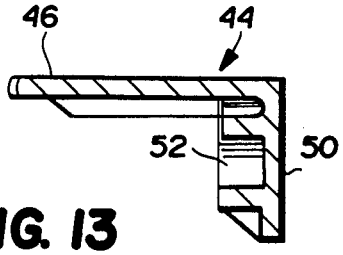
FIG. 13
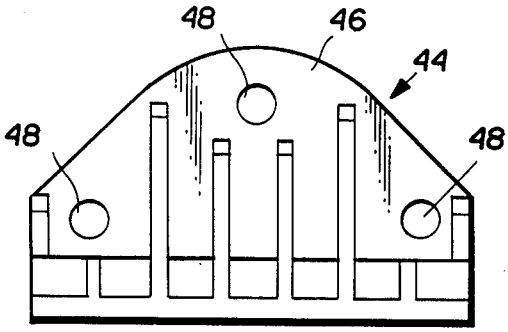
FIG. 14

TASK CHAIR

BACKGROUND OF THE INVENTION

This invention relates to task or work chairs of the type typically associated with office work stations, and specifically for use in the performance of certain tasks such as keyboard entry of data into computers, typing and the like.

In the past, various attempts have been made to provide office chairs with several degrees of adjustability built into the chair to maximize comfort, minimize fatigue, and so on. For example, it is well known to utilize a pneumatic piston/cylinder arrangement to raise or lower the chair seat to the desired vertical position. In addition, it is known to provide vertical adjustability for a seat back mounted on a substantially vertical or L-shaped post. Typically, it is the case that the seat back mounting post is slidably mounted for horizontal movement toward or away from a seat mounting plate which is connected to the piston for vertical reciprocation. In this way, the spatial relationship of the chair back to the chair seat may be changed as desired. It is also a characteristic of this type of chair that the substantially vertical or L-shaped seat back post be constructed of a relatively thin and relatively narrow, e.g., 1.5 to 2.0 inches, strip of metal, such as steel, which will permit the seat back to recline or flex backwardly under pressure by the user. Alternatively, the seat back post may be pivotally mounted to the seat mounting plate for spring-biased reclining action.

In chairs of the above mentioned type, the pressure required to recline the seat back increases significantly as the seat back approaches the limit of its movement. As a result, rather than being in a relaxed orientation, the user is actually working hardest as the seat back reaches the limit of its reclining action.

Another problem frequently experienced with prior art chair designs has to do with the fact that to make seat adjustments, it is necessary to stand up, adjust the chair, and then sit down to see if the correct adjustment has been made. If it has not, then the process must be repeated.

Conventional chairs also in most cases lack the capability for adjusting the pitch of the seat with respect to the chair back.

It is the primary object of this invention to overcome the problems experienced with prior art office-type chairs by providing an office, or task, chair which facilitates mental activity, minimizes fatigue, conforms to all body types and sizes, and which incorporates simple manual controls, all but one of which can easily be reached while the user is sitting in the chair.

In accordance with a preferred embodiment of this invention, an office-type chair is provided in which:

(a) seat pitch can be adjusted within a 10° range, so that, for example, the seat may be pitched downward for optimum computer keying tasks, or upward for other tasks;

(b) seat height with respect to the floor can be raised or lowered approximately 4½ inches;

(c) seat depth, i.e., the distance between the seat and the seat back, may be adjusted up to two inches;

(d) the seat back pitch may be adjusted with respect to the seat, i.e., the back reclines up to 20°, for providing lumbar region support in all positions;

(e) the seat back may be raised or lowered up to 2 inches independently of the seat, to accommodate users of various size.

To carry out the various adjustments, a plurality of adjustment mechanisms are employed. Before describing these mechanisms in detail, however, it is important to understand the basic structure of the chair.

In one exemplary form of a chair, a pneumatic piston and cylinder extends between a five spoke pedestal base and a seat supporting brace. The brace is an integrally formed, combination horizontal seat support and generally vertical seat back support post, having a stylized L-shape.

It will be appreciated that actuation of the pneumatic piston will raise or lower both the seat and the seat back by reason of the unitary brace construction.

A lever is provided within reach of a user seated on the chair for actuating the piston/cylinder to effect upward or downward movement of the seat. This, of course, is advantageous in that the user is not required to adjust the seat in a trial and error-type operation.

The seat portion of the chair is slidably mounted on the support brace and pivotally movable with respect thereto so as to enable both horizontal sliding and pitch adjustment of the seat relative to the seat back.

A pair of concentrically arranged, inner and outer handwheels are located centrally and just behind the lower front edge of the seat for adjusting both the depth and the pitch of the seat. While the adjusting wheels are concentrically arranged, the adjustments themselves are independent of each other so that the seat is forwardly and rearwardly slidable at any adjusted pitch angle. Here again, the adjustment mechanism is within easy reach of a user seated on the chair.

The pitch adjustment is particularly useful because it allows the seat to be tilted, or canted, forwardly to a position which has been determined to be most desirable for carrying out certain office tasks, particularly keying data into a computer.

Pitch adjustment is effected by an adjustable screw, connected to the inner handwheel, which abuts a recessed dimple in a plate secured to the seat bottom. The rearward position of the seat is pivotally secured so that, upon rotation of the inner handwheel, the front of the seat is caused to pivot upwardly or downwardly, depending on the direction of rotation of the screw.

The outer handwheel of the concentric pair of handwheels acts to loosen or tighten the seat against the stationary brace to which it is slidably mounted.

A third handwheel is located on the rearward side of the seat back for purposes of adjusting the height of the seat back along the substantially vertical seat back support portion of the brace.

It is also a characteristic of the chair that the seat back and seat back support portion of the brace be reclinable with respect to the seat and seat support portion of the brace. This is accomplished as the result of carefully orchestrated removal of material from the brace in an area which connects the seat support portion to the seat back support portion. In a preferred embodiment, this connecting area is defined by a rearwardly looped, generally C-shaped integral hinge or flex connection. Material is removed from this area, preferably in the form of slots which extend throughout the C-shaped portion and, at least to some extent, into the vertical and horizontal portions of the brace. This structure permits the seat back to recline away from the seat within a range of 20° from its normal, generally vertical position.

In addition, because of the careful tuning of the brace through this selective removal of material, the force required to move the seat back through the first 5° of its range of inclination remains generally constant. In other words, there are no increasing compressive forces exerted against the user as the seat back moves through the first 5° of its 20° range. It is this first 5° that is considered the normal operating range most often encountered during use of the chair. Reclining between 5° and 20° generally occurs only sporadically while stretching, etc.

The pneumatic piston and cylinder arrangement and the five spoke pedestal base, which typically includes associated casters, are of conventional design.

BRIEF DESCRIPTION OF THE DRAWINGS

FIG. 8 is a side view of a unitary brace for use with the chair in accordance with this invention, shown in association with a height adjusting cylinder and with a double handwheel adjustment assembly for adjusting a seat with respect to the brace;

FIG. 9 is a partial top view of the brace illustrated in FIG. 8, with the double handwheel removed;

FIG 10 is a front view of the brace illustrated in FIG. 8 and further showing a detail of how a seat is mounted to the brace in accordance with an exemplary embodiment of the invention;

FIG. 11 is a detailed cross-sectional view of a concentrically arranged double handwheel assembly for adjusting a seat in accordance with an exemplary embodiment of the invention;

FIG. 12 is a front view of a slide adjustment plate for use in mounting a seat to a seat support in accordance with an exemplary embodiment of the invention;

FIG. 13 is a sectional view of the slide adjustment plate taken along the line 13—13 in FIG. 12; and FIG. 14 is a top plan view of the slide adjustment plate illustrated in FIG. 12.

DETAILED DESCRIPTION OF THE INVENTION

Figure 1:
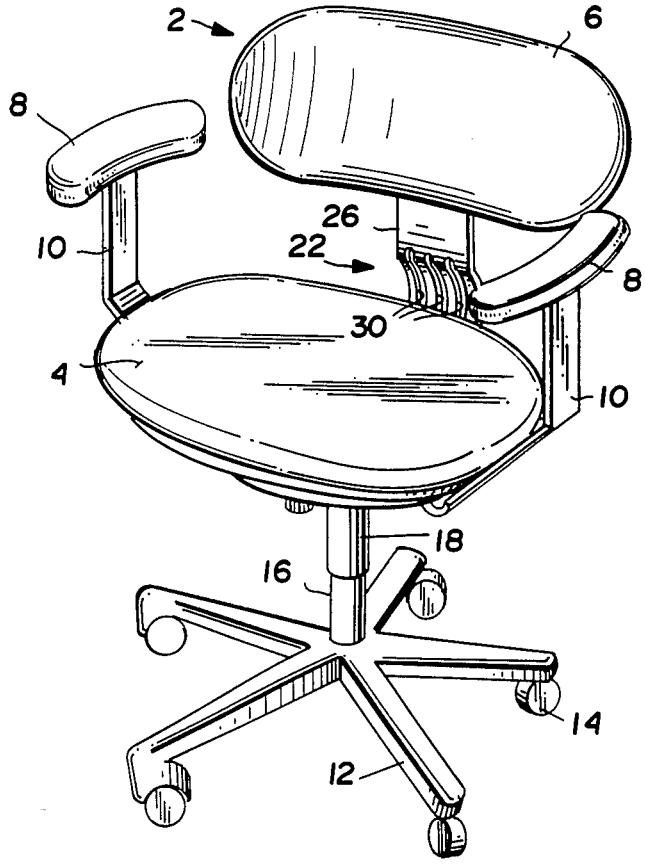
FIG. 1 is a perspective view of a task chair in accordance with an exemplary embodiment of this invention.
Figure 2:
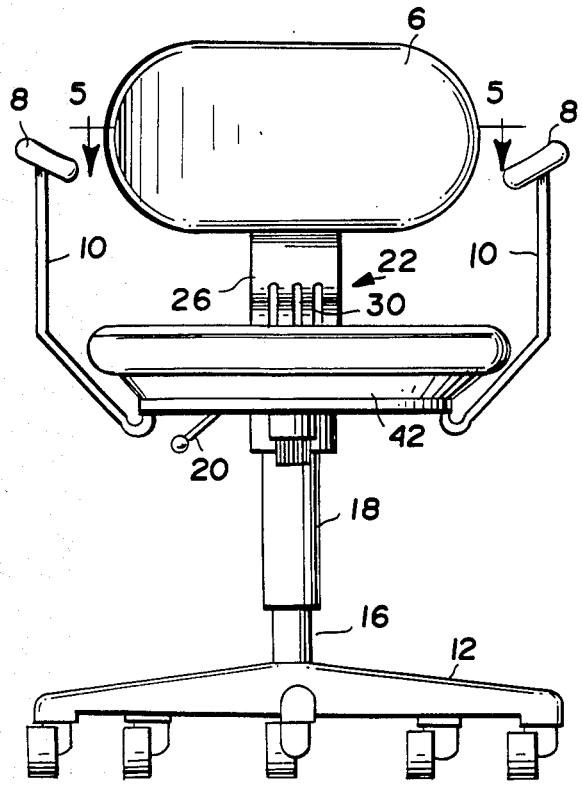
FIG. 2 is a front view of the chair illustrated in FIG. 1.
Figure 3:
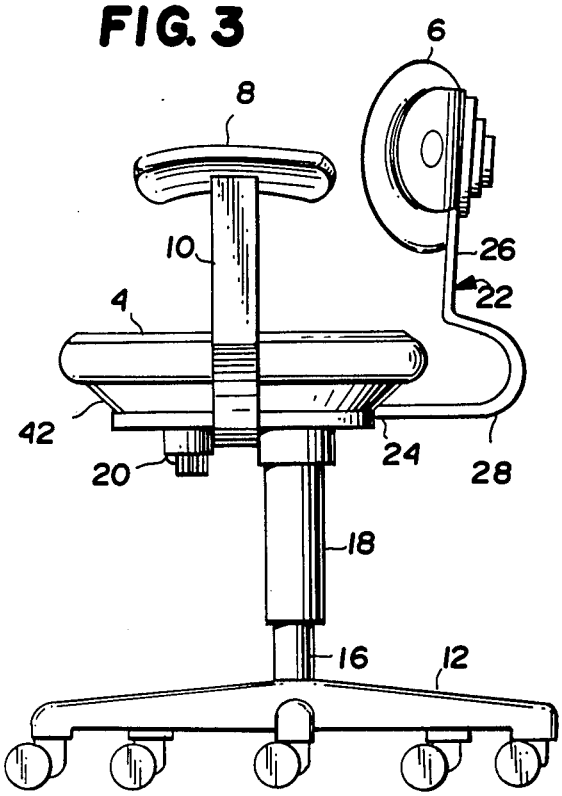
FIG. 3 is a side view of the chair illustrated in FIG. 1.
Figure 4:
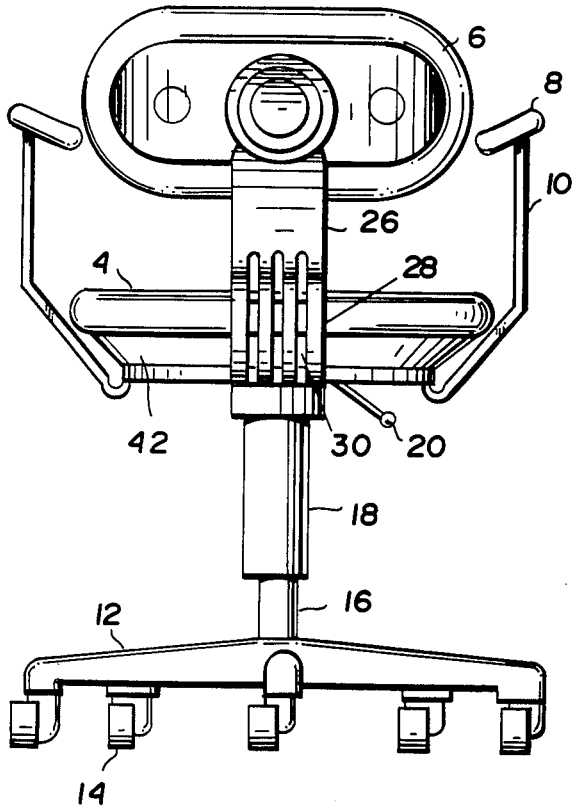
FIG. 4 is a rear view of the chair illustrated in FIG. 1.

Referring to FIGS. 1 through 4, there is illustrated an adjustable task chair which will first be described in general terms. The chair 2 is provided with a seat 4, a seat back 6, arms pads 8 mounted on arm support members 10, a pedestal base 12 and casters 14. The seat is operatively connected to, and rotatable about, the pedestal base through a piston and gas cylinder assembly 16 which is partially covered by a cylindrical sleeve 18. The piston/cylinder assembly 16 serves to adjust the height of the seat and seat back with respect to the pedestal base (and floor) via an actuating lever 20.

The pedestal base with casters is of a conventional type well known in the art, as is the utilization of a piston/gas cylinder arrangement for adjusting the height of the seat. The particular details associated with these aspects of the chair need not be described further herein.

In accordance with this invention, a unitary, or integral, combination seat support and seat back support brace 22 has welded on the underside thereof a sheet metal box element 25 (see FIG. 8) which receives the sleeve 18 as well as the piston/cylinder height adjustment mechanism. The piston/cylinder mechanism is located at a position along the seat support portion 24 of the brace 22 so as to provide the most stable arrangement for all horizontally adjusted positions of the seat.

The seat is mounted for sliding as well as for pivotal movement with respect to the brace 22. This unique mounting arrangement, described in greater detail below, permits forward and backward adjustment of the seat along the brace 22 and, at the same time, permits independent pitch adjustment of the seat about a pivot point located toward the rear of the seat.

The seat back 6 is slidably mounted on the substantially upright seat back support portion 26, hereinafter referred to simply as the back support portion, of the brace 22 for vertical adjustment relative to the seat 4.

The seat back 6 is also permitted to tilt or recline with respect to the seat 4 by reason of the unique configuration of the brace 22, and particularly by reason of the slotted, curved hinge area 28 which interconnects the seat support portion 24 and the back support portion 26.

A detailed description of the chair construction and the adjustment mechanisms associated therewith follows.

THE UNITARY SEAT AND BACK BRACE

The brace 22, including integrally formed seat support portion 24 and back support portion 26 is shown in further detail in FIGS. 8 through 10.

The brace 22 is constructed of steel, preferably 1070 hot rolled steel approximately 0.187 inches in thickness, and heat treated to spring temper and a Rockwell C hardness of 44–48. The brace is preferably about 3.50 inches wide, in contrast to prior art back support posts which are typically 1.50 to 2.0 inches wide. The additional width of the brace 22 provides substantial support for the seat back 6 but, at the same time, allows the back support portion to tilt rearwardly about 20° from its normal at rest position, which is about 5° rearward of vertical, by reason of the configuration of the curved hinge or connection area 28.

The curved hinge or connection area 28 defines essentially a 2.0 inch radiused portion which extends rearwardly, i.e., concavely, away from the substantially upright back support portion 26 before merging with the horizontal seat support portion 24. Extending throughout the entirety of the connection portion, and extending slightly into both the back and seat portions, respectively, are a plurality of apertures in the form of elongated slots 30. The slots, preferably three in number, are approximately 0.50 inches in width and approximately 8.0 inches in length. As a result, the back support portion 26 is permitted to flex or pivot rearwardly through an approximately 20° range from its normal position. Significantly, the carefully orchestrated removal of material from the brace by reason of the specific configuration of the slots, enables rearward flexing in the first 5° of the 20° range to occur upon exertion of a substantially constant amount of force or effort.

In other words, this chair is unlike prior art chairs where increasing effort is required a the chair back moves through its tilting range. The substantially constant amount of effort or force required to move the seat back through the normally utilized 5° range of rearward flexing is one of the essential features of the chair according to this invention.

It has also been found that the curved and slotted configuration of the connection or hinge area 28 allows the seat back portion to twist about its longitudinal axis so as to accommodate and absorb rotational forces exerted thereon from time to time by the user of the chair.

The brace 22 is further characterized by a slot 32 adjacent a curved upper end of the back support portion 26 which permits vertical adjustment of the seat back 6 as described in further detail below.

The horizontal, seat support portion 24 includes a downwardly angled connector portion 34 which merges with a horizontal offset portion 36. This configuration facilitates the mounting of the seat 4 to the brace in a manner to be hereinafter described.

Immediately forward of the connector portion 34, there is a hole 38, located centrally of the box 25, which is reamed to accept a tapered portion of the piston/cylinder assembly 16.

The forward end of the seat support portion 24 of the brace 22 is formed with an open-ended slot 40 which enables the seat 4 to slide horizontally forward and backward with respect to the brace 22, and seat back 6, in a manner described in detail below.

SEAT CONSTRUCTION AND ADJUSTABLE MOUNTING

The seat 4 is constructed of a suitable base material, such as ¾ inch plywood, and covered on its upper side with conventional padding, such as 3.2 lb. density high resiliency urethane foam, approximately two inches in thickness, and covered with suitable upholstery material. The underside of the seat is protected by a thermoplastic cover 42, as shown in FIGS. 1 through 4 and 11.

The underside of the seat 4 is further provided with a pair of slide adjustment angle brackets, one of which is shown in FIGS. 12 through 14. The bracket 44 is provided with an upper, horizontal mounting flange 46 provided with a plurality of holes 48 by which the brackets may be fixedly attached to the underside of the seat, rearwardly of the seat center, by screws or other suitable fasteners. A vertically downwardly extending wall 50 is formed with a horizontally oriented, elongated slot 52, approximately 2.50 inches in length. A pair of brackets 44 are mounted on the underside of the seat so as to be located on either side of the brace 22, in lateral alignment with upstanding ears or flanges 52, 54 provided on the sheet metal box 25, as partially shown in FIG. 10. Aligned apertures 56, 58 formed in flanges 52, 54, respectively, receive a slide adjustment rod 60 which extends laterally outwardly beyond the flanges. The rod is secured within the apertures, preferably by tack welding.

The seat is mounted such that the ends of rod 60 are received in slots 52 of brackets 44. By this arrangement, horizontal adjustment of the seat 4 toward or away from the seat back is facilitated. At the same time, the slide adjustment rod serves as a pivot axis about which the seat may be tilted to adjust the pitch thereof.

In the center forward section of the underside of seat 4, there is mounted a seat pitch/depth knob assembly 64 which, in conjunction with brackets 44, serves as a third mounting point for the seat 4 to the brace 22. As best seen in FIG. 11, the assembly 64 comprises a retaining plate 66 fastened by screws 68 to the plywood base of the seat 4. The plate is pierced at 70 to receive a reduced neck portion 72 of a pitch adjustment stud 74. The plastic cover 42 on the underside of seat 4 is dimpled at 76 so as to receive and capture a relatively enlarged head 78 of the stud 74. A threaded shank portion 80 of the stud 74 extends downwardly away from the seat and terminates in a pitch adjustment knob 82 molded about the stud end 84.

A pitch adjustment sleeve 86 is provided with an annular groove or slot 88 by which the sleeve is mounted for sliding movement within the slot 40 provided in the brace 22. The sleeve 86 is further provided with a threaded bore 90 for threadably receiving the pitch adjustment stud 74. By this arrangement, it will be appreciated that by turning the pitch adjustment knob 82, the forward end of the seat 4 is caused to be raised or lowered about the slide adjustment rod 60. A pitch adjustment of about 5° on either side of horizontal is permitted with the disclosed configuration.

At the same time, it will be appreciated that because rod 60 is slidably received within slots 52 of brackets 44, and because sleeve 86 is slidably received within slot 40 of brace 22, the seat 4 may be moved forward or backward, regardless of the pitch angle, within a range of two inches, as indicated by dimension A in FIG. 8. In other words, the horizontal forward and rearward sliding movement of the seat is independent of the pitch angle adjustment.

The sleeve 86 is also provided with an exterior threaded portion 92 which receives an annular seat slide adjustment knob 94 which is formed with an annular bearing surface 96 designed to engage the underside of brace 22. It will be appreciated that by loosening knob 94, the seat 4 may be adjusted horizontally through its approximately two inch range of movement. Tightening of the knob locks the seat in the desired position. As is clearly illustrated in FIG. 11, knobs 82 and 94 of the assembly 64 are concentrically arranged, one within the other, so as to provide dual, independent adjustment at one convenient location on the underside of the seat 4. The location of the dual seat pitch/depth knob assembly 64 is designed to permit easy adjustment of the chair seat by the user while in the seated position.

SEAT BACK CONSTRUCTION AND ADJUSTABLE MOUNTING

Figure 5:
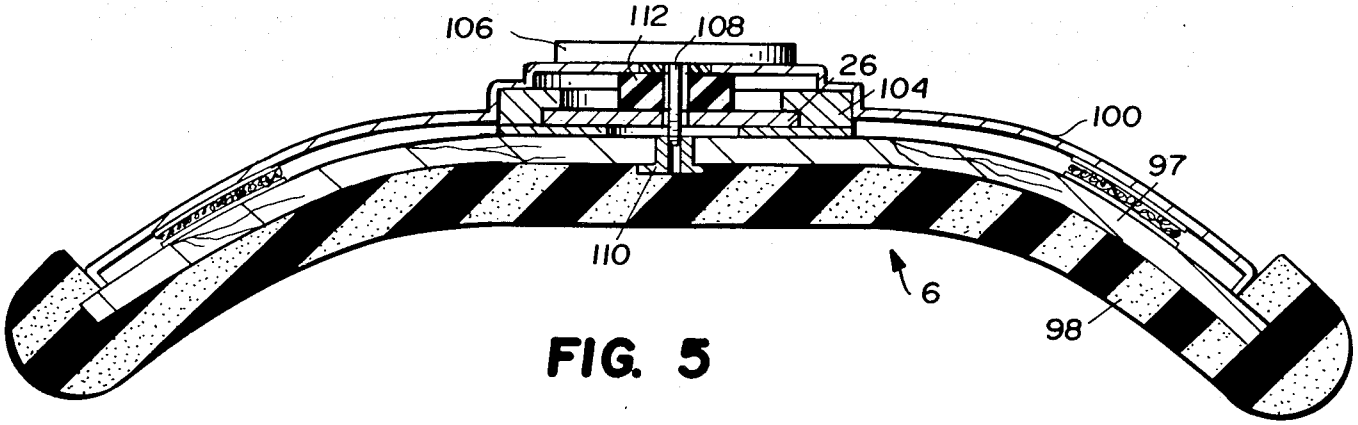
FIG. 5 is a cross-sectional view of a seat back taken along the line 5—5 of FIG. 2.
Figure 6:
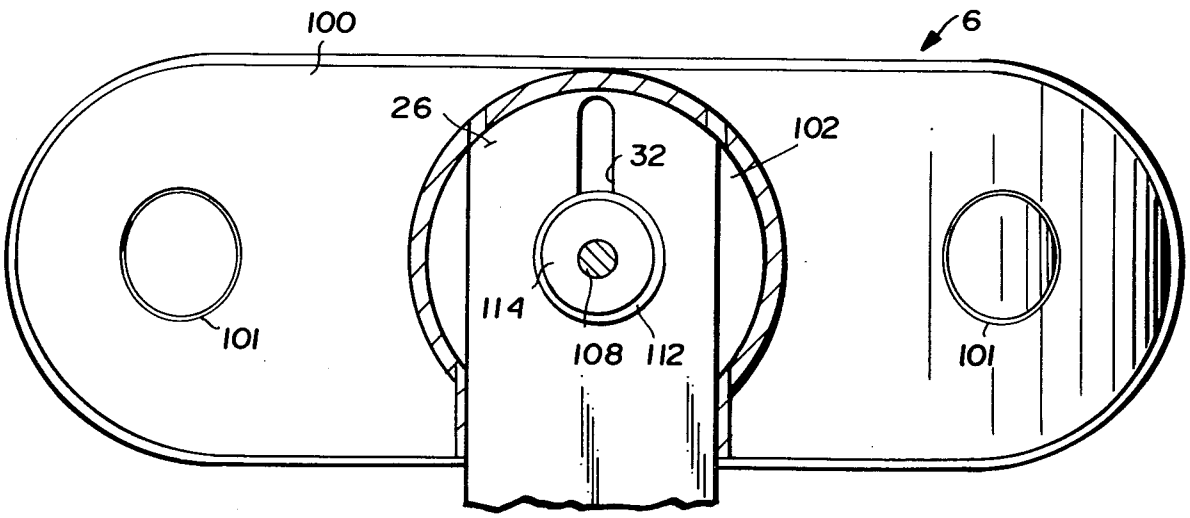
FIG. 6 is a partial cross-sectional view of the rearward facing cover of the seat back illustrated in FIG. 5 and further in conjunction with a seat back support post.

With reference now to FIGS. 5 and 6, it may be seen that the seat back 6 is also constructed so as to include a plywood base 97, preferably about ⅜ inch thick and padded with a 2.7 lb. density urethane foam 98. The padding is covered with upholstery material (not shown), preferably identical to that used on the seat 4. The rearward facing surface of the back 6 is covered with a thermoplastic cover 100, similar to the lower seat cover 42, which is approximately 0.080 inches thick and held in place by any suitable fastening means preferably located laterally outwardly of the cover center, as at 101. The fastening means may comprise, for example, one or more pressure sensitive adhesive pads at each location 101.

Figure 7:
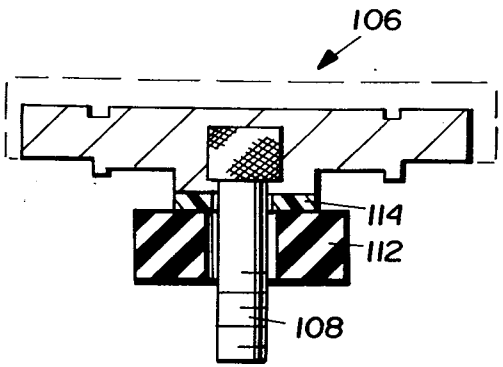
FIG. 7 is a cross-sectional view of a seat back adjustment knob assembly.

In the central region of the cover 100, there is an integrally formed or molded recess 102 which is configured to receive a molded insert 104 which cooperates with recess 102 to form a slot by which the seat back 6 is slidably mounted on the substantially vertical seat back support portion 26 of the brace 22. A seat back height adjustment knob 106, as best seen in FIG. 7, is molded about a threaded stud 108 which passes through the insert 104, slot 32 in the back support 26, and is threadably received in a T-nut 110 secured within the plywood base 96.

A relatively thick neoprene washer 112, with a relatively thin nylon washer 114 adhered to one face thereof, is located within the insert 104 between the knob 106 and the back support portion 26. With knob 106 rotated to a loosened position, the seat back 6 may be slidably raised or lowered on the back support portion 26 of brace 22 to the desired position, within a range of about two inches, as limited by slot 32. Subsequent tightening of the knob 106 compresses the neoprene washer 112 to create a friction lock between the seat back 6 and back support portion 26.

From the foregoing description, it will be appreciated that the task or work chair according to the present invention affords the user thereof with a high degree of flexibility and adjustability not heretofore found in chairs of this type.

While the invention has been described in what is presently regarded as its most practical embodiment, it will be appreciated by those of ordinary skill in the art that various changes and modifications may be made therein without departing from the spirit and scope of the claims which follow.

What is claimed is:

1. A chair comprising a base, a seat operatively connected to said base through an intermediate member, and a seat back, wherein the seat and seat back are mounted on a single, elongated support brace, said brace comprising a seat support portion mounting said seat and a seat back support portion mounting said seat back, said seat support and seat back support portions connected by an integrally formed hinge portion; first means adjustably mounting said seat for linear movement toward and away from said seat back and the seat back support portion; and second means, independent from said first means, adjustably mounting the seat for pivotal movement about a horizontal axis extending in a direction perpendicular to the seat support portion of said brace to alter the pitch of the seat, such that linear adjustment of said seat may be accomplished without effect of the pitch of the seat, wherein first and second concentrically oriented adjustment knobs are provided for effecting adjustments permitted by said first and second means, respectively.

2. A chair as define in claim 1 wherein said knobs are individually and independently actuatable.

3. A chair comprising a base, a seat operatively connected to said base, and a seat back, wherein the seat and seat back are mounted on a single, elongated support brace, said brace comprising a seat support portion and a seat back support portion connected by an integrally formed hinge portion; said chair further comprising first means for adjustably mounting said seat for sliding movement toward and away from said seat back and the seat back support portion; and second means for adjustably mounting the seat for pivotal movement about a horizontal axis extending in a direction perpendicular to the seat support portion of said brace; and wherein first and second concentrically oriented adjustment knobs are provided for effecting adjustments permitted by said first and second means, respectively.

4. A chair as defined in claim 3 wherein said knobs are individually actuatable to permit independent adjustment by said first and second means.

5. A chair according to claim 1, wherein said first and second means include a pair of laterally spaced brackets fixed to the underside of said seat, each bracket including an elongated slot; a slide adjustment rod fixedly mounted relative to said seat support portion, opposite ends of which are slidably received said elongated slots; and an elongated substantially vertically oriented stud depending from the underside of said seat and received in an annular, bored sleeve mounted for sliding movement in an elongated slot formed in said seat support portion.

6. A chair according to claim 5, wherein said annular sleeve is provided with exterior threads, and a first adjustment knob is threadably secured to said sleeve, said adjustment knob provided with means for engaging said seat support portion so that when said first knob is loosened relative to said seat support portion, the seat may slide relative to said seat support portion toward or away from said seat back, and when said first knob is tightened against said seat support portion, the seat will be prevented from sliding relative to said seat back.

7. A chair according to claim 6 wherein said elongated stud is threaded and said bored annular sleeve is provided with interior threads, said stud being threadably received in said sleeve, wherein rotation of said stud pivots said seat upwardly or downwardly about said slide adjustment rod, relative to horizontal, thereby changing the pitch of the seat.

8. A chair according to claim 7 wherein a second adjustment knob is attached to said elongated stud for effecting said pitch adjustment, and wherein said first and second knobs are concentrically arranged, one within the other.

* * * * *